United States Patent [19]

Price et al.

[11] 4,386,860

[45] Jun. 7, 1983

[54] HIGH SPEED LABEL PRINTER

[75] Inventors: Robert J. Price; Bruce C. Taber, both of El Cajon, Calif.

[73] Assignee: Data Card Corporation, Minnetonka, Minn.

[21] Appl. No.: 243,564

[22] Filed: Mar. 13, 1981

[51] Int. Cl.[3] ..... B41J 3/12; B41J 11/44

[52] U.S. Cl. ..... 400/124; 400/636; 400/613; 101/288; 242/78.6

[58] Field of Search ..... 400/636, 641, 124, 613; 101/288, 93.05; 226/104, 116, 118, 168, 117; 242/182, 78.6

[56] References Cited

U.S. PATENT DOCUMENTS

| | | | |
|---|---|---|---|
| 2,161,228 | 6/1939 | Littell | 242/78.6 |
| 3,108,534 | 10/1963 | Preisinger | 400/124 |
| 3,291,414 | 12/1966 | De LaMotte | 242/78.6 |
| 3,467,232 | 9/1969 | Paige | 400/124 |
| 3,592,311 | 7/1971 | Chon et al. | 400/124 |
| 3,770,091 | 11/1973 | Platt | 400/124 |
| 3,782,520 | 1/1974 | Howard | 400/124 |
| 3,819,130 | 6/1974 | Moxness | 242/199 |
| 3,833,891 | 9/1974 | Howard et al. | 400/124 |
| 3,850,355 | 11/1974 | Downie et al. | 400/641 |
| 3,904,011 | 9/1975 | Matschke | 400/124 |
| 3,942,620 | 3/1976 | Dillinger et al. | 400/124 |
| 3,995,731 | 12/1976 | Miller et al. | 400/195 |
| 4,004,671 | 1/1977 | Kondur, Jr. | 400/124 |
| 4,010,835 | 3/1977 | Martin et al. | 400/124 |
| 4,027,590 | 6/1977 | Seidl et al. | 101/288 |
| 4,030,590 | 6/1977 | Wojdyla | 400/124 |
| 4,061,219 | 12/1977 | Nishikawa et al. | 400/124 |
| 4,072,224 | 2/1978 | Barnaby et al. | 400/124 |
| 4,079,824 | 3/1978 | Ku | 400/124 |
| 4,091,909 | 5/1978 | Lee | 400/124 |
| 4,096,578 | 6/1978 | Malkemes | 364/900 |
| 4,109,777 | 8/1978 | Ottenstein | 400/124 |
| 4,120,245 | 10/1978 | Karp et al. | 101/288 |
| 4,165,191 | 8/1979 | Dickson et al. | 400/124 |
| 4,169,683 | 10/1979 | Bernardis et al. | 400/124 |
| 4,175,876 | 11/1979 | Hanaoka | 400/124 |
| 4,192,618 | 3/1980 | Kondur, Jr. et al. | 400/124 |
| 4,197,024 | 4/1980 | Huntoon | 400/636 |
| 4,200,401 | 4/1980 | Roy et al. | 400/124 |
| 4,240,862 | 12/1980 | Ishiyama | 101/66 |
| 4,264,396 | 4/1981 | Stewart | 101/288 |
| 4,276,112 | 6/1981 | French et al. | 101/288 |
| 4,279,372 | 7/1981 | Giros | 226/104 |

FOREIGN PATENT DOCUMENTS

| | | | |
|---|---|---|---|
| 55-21243 | 2/1980 | Japan | 101/288 |
| 55-148187 | 11/1980 | Japan | 101/288 |

OTHER PUBLICATIONS

Wiese, "High Speed . . . Printer", IBM Technical Disclosure Bulletin, vol. 17, No. 12, p. 3550.

*Primary Examiner*—William Pieprz

*Attorney, Agent, or Firm*—Staas & Halsey

[57] ABSTRACT

A high speed label printer includes a supply roll for supplying connected labels which are adhesively attached to a backing strip, to a pair of printing heads for printing indicia thereon. A platen provides support for the label during the printing operation and the backing is peeled from the label as it is drawn over the platen. A pair of friction drive rollers engage the peeled backing and are driven by a stepper motor to transport the labels past the printing heads. A housing for the supply roll of labels has spacers which confine the extent to which the roll unravels in the housing. When the stepper motor is started, the unravelled outer turns of the supply roll are initially withdrawn from the supply roll housing, thereby exerting a minimal torque on the stepper motor during start-up.

14 Claims, 13 Drawing Figures

HIGH SPEED LABEL PRINTER

BACKGROUND OF THE INVENTION

1. Field of the Invention

This invention relates to a high speed printing apparatus for high speed intermittent printing on labels fed from a continuous supply roll.

2. Description of the Prior Art

There exists, in the prior art, label printing apparatus for printing on labels, in which a supply of labels having uniform indicia applied thereto are transported past a printer which then prints selective, variable indicia on each of the labels. Use of such pre-printed labels requires precision control in feeding the labels to the printer. Since each label of the supply roll contains uniform pre-printed information, it is necessary to accurately feed a single label at a time so that printing of the individual indicia will take place on the same portion of every label. In most prior art systems in which labels are intermittently fed to a printer, a large start-up torque is placed on the motor for driving the label supply due to the large inertia of the supply roll. This large start-up torque is applied each time a label is to be printed, thereby requiring that a relatively large motor be used. In addition, such prior art apparatus often fail to accurately position the label for printing on the preselected area of the label. This is, in part, due to the large size of the motor required because of the high start-up torque.

There is therefore a need in the industry for a label printing apparatus which is capable not only of accurately positioning a pre-printed label at a printing station, but which is also capable of transporting a supply of labels into a printing position at high speed without placing a large start-up torque on the drive motor.

SUMMARY OF THE INVENTION

An object of the present invention is to provide a high speed label printing apparatus which overcomes the deficiencies of prior art apparatus.

In particular, it is an object of the present invention to provide apparatus for accurately positioning a pre-printed label at a printing station so that selected variable indicia may be printed on the pre-printed label.

A further object of this invention is to provide apparatus for feeding the pre-printed labels from a continuous supply roll in such a manner that a minimal start-up torque is placed on the system drive motor, so that a small drive motor may be employed.

The system of the present invention has a number of novel features, as set forth below. A supply roll housing holds a supply roll of pre-printed labels upon each of which variable selected indicia are to be printed. The supply roll is fed through a guide to a printing station including a dual headed wire printer and platen. The platen serves the combined purpose of providing support for the label while it is being printed on and subsequently for peeling a backing strip from the adhesive-coated label. The peeled backing is fed to a pair of friction rollers, one of which is driven, to frictionally engage the backing strip, and hence drive the supply of labels past the printer. The individual labels are perforated and have a sensing hole at each end. The backing strip is continuous but has holes which align with the holes in the labels. A photocell detects the presence of a hole and generates a detection signal for a control circuit which precisely controls the movement of the labels past the dual headed wire printer. The supply roll of pre-printed labels is freely rotatable about a fixed spindle, and the supply roll housing is designed so that when the friction rollers drive the label backing strip the labels are withdrawn from the supply roll housing. When the friction rollers cease to be driven, the supply roll, due to the momentum, tends to continue to rotate on the fixed spindle so that the outer turns of the supply roll become unravelled about the remainder of the supply roll. Then, when the drive motor for driving the friction rollers is actuated once again, the unravelled outer turns are freely withdrawn from the supply roll because of their low inertia. After a start-up period, the supply roll again begins to rotate on the fixed spindle. Thus, the start-up torque on the drive motor is kept relatively low and a small motor with excellent control may be employed.

These together with other objects and advantages, which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
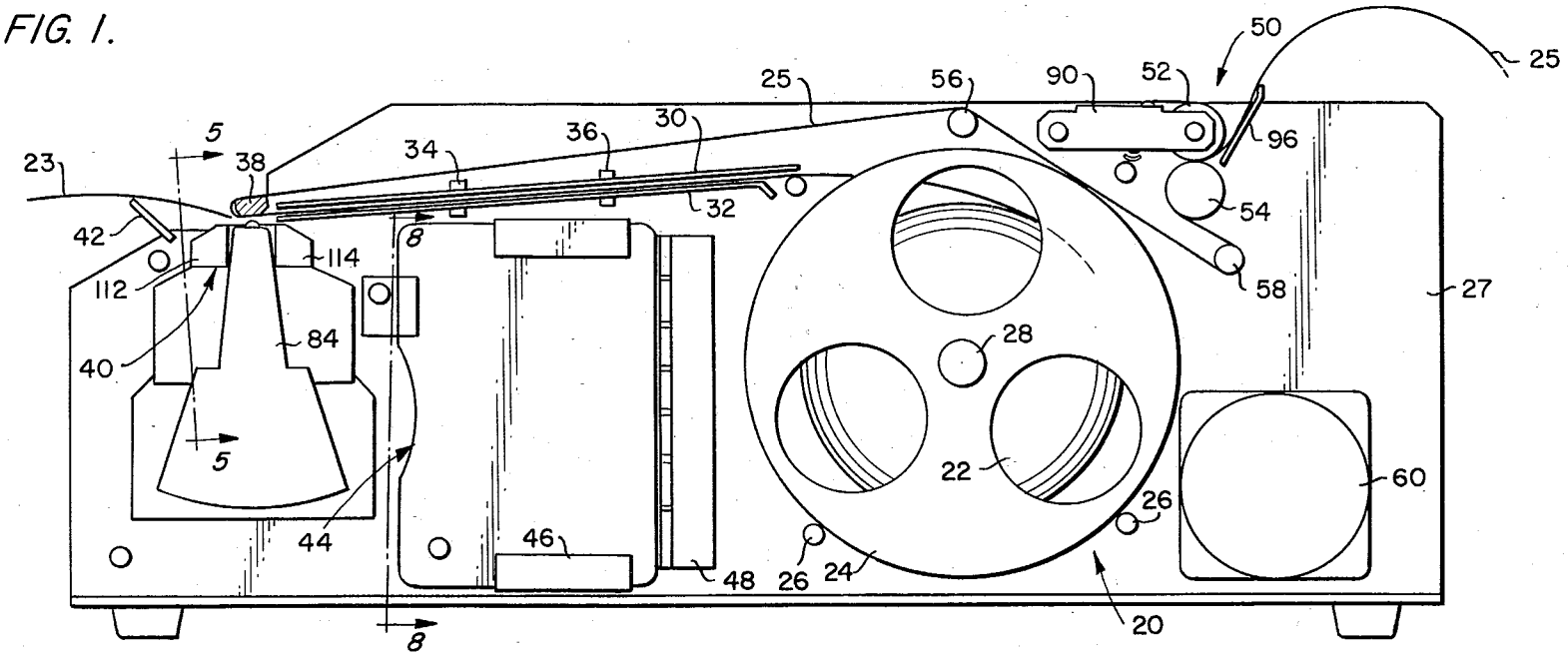
FIG. 1 is a right side elevational view of the label printing apparatus of the present invention with the outer housing of the apparatus removed, illustrating the printing station and the path of the labels.

FIG. 1 is a right side elevational view of the printing apparatus of the present invention. A label supply roll housing, generally designated as 20, holds a supply roll 22 of interconnected detachable labels.

Figure 3:
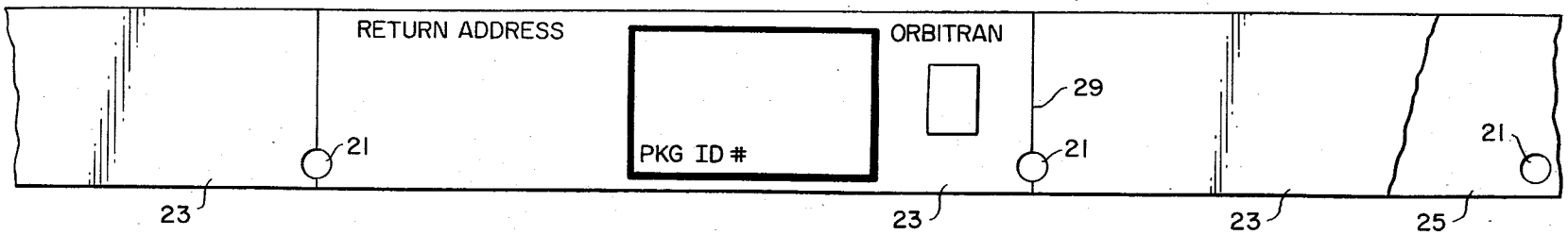
FIG. 3 illustrates a pre-printed label of the type which may be used in the printing apparatus of the present invention.

A label 23 is illustrated in FIG. 3. Each label 23 carries uniform pre-printed indicia and is separable from the succeeding label 23 at a common cut line 29 and a hole 21. Each label 23 has an adhesive side which is attached to a continuous removable backing strip 25. The backing strip 25 does not have a cut line 29 but does have a hole 21 which aligns with the hole 21 on the labels. Returning to FIG. 1, the supply roll housing 20 includes a label cover 24 and a plurality of spacers 26 for limiting the unravelling of the supply roll 22 during operation. The label cover 24 is attached to a fixed spindle 31 (FIG. 7) by a latch 28. The labels 23 are transported from the supply roll 22 in a path through a pair of guides 30 and 32 mounted on the printer housing 27 and past a pair of photocells 34 and 36 mounted adjacent the guides. Two photocells are provided so that different size labels may be printed. Only one of the photocells 34 and 36 is employed during the printing operation. A printing station 40 includes a platen 38 which is mounted on the printer housing 27 in opposition to a pair of printing heads 84 and 86 (FIG. 5) for printing on the labels 23. The platen 38 serves as a support for the label 23 as it is being printed upon by the printing heads 84 and 86 and also serves as a peeling edge for peeling the backing strip 25 from a printed label 23. Peeling takes place due to the rigidity of the label 23 and the transport of the backing strip 25 around the platen. Once the label 23 has been printed and peeled from the backing strip 25, the label 23 is deflected by a label deflector 42 out of the printing apparatus, where it may be manually removed from the printing apparatus by an operator. In an alternative embodiment, the printing apparatus includes a device for automatically severing the printed label 23 from the succeeding label 23 after it has been peeled from the backing strip 25. A ribbon supply 44 supplies the ribbon which the printing heads 84 and 86 impact to print on the label 23. The ribbon supply 44 is held by a bracket 46 which is mounted to the printer housing 27 by a hinge 48.

Figure 2:
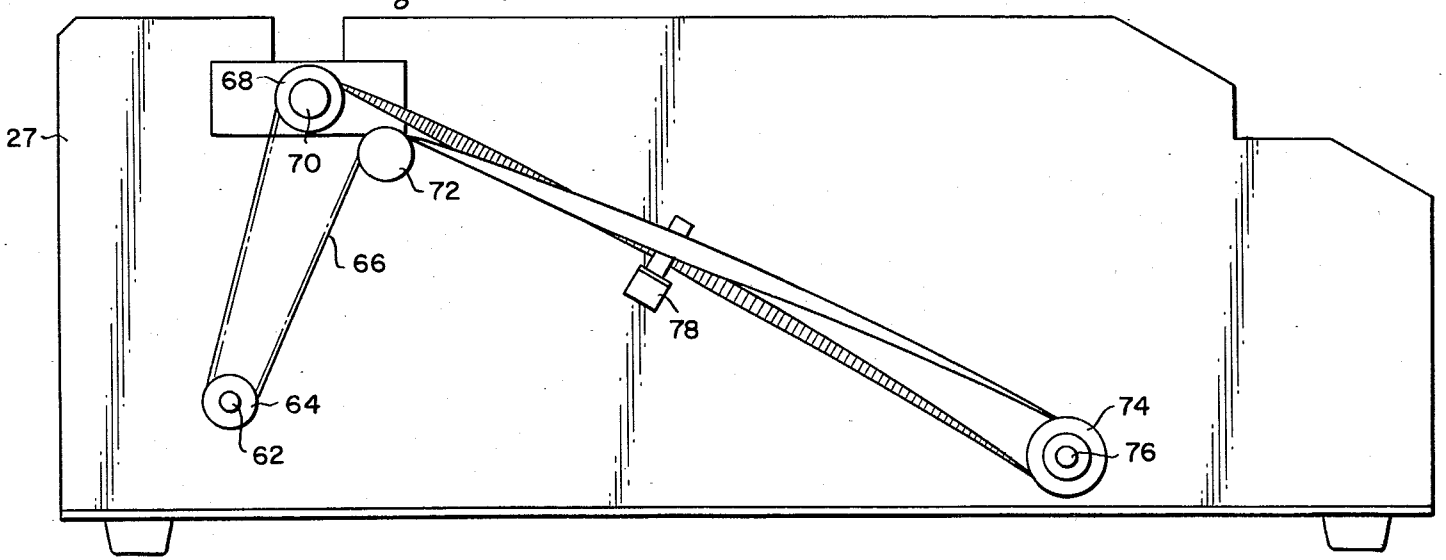
FIG. 2 is a left side elevational view, with the outer housing removed, of the drive portion of the printing apparatus.

The labels 23 are successfully transported past the printing heads 84 and 86 by friction drive means, generally indicated at 50, which engage the backing strip 25 at a location far removed from the platen 38. In the preferred embodiment, the friction drive means 50 includes a freely rotatable urethane roller 52 and a driven urethane roller 54. Urethane rollers are employed instead of the typical drive pinions which grab and crimp the backing 25. Thus, the drive of the rollers 52 and 54 is produced solely by the coefficient of friction between the urethane and the backing 25. The backing strip 25 is frictionally engaged by the rollers 52 and 54 so that as the driven roller 54 is rotated, the backing strip 25, and hence the labels 23 are withdrawn from the supply roll housing 20. A pair of guides 56 and 58 extending from the printer housing 27, directs the backing strip 25 into the friction drive means 50. A motor 60 drives the friction drive roller 54 and the ribbon supply 44 (FIG. 2). In the preferred embodiment, the motor 60 is a DC stepper motor.

FIG. 2 illustrates a left side elevational view of the elements for driving the ribbon supply 44 and the friction drive means 50. The motor 60 drives a motor shaft 62 on which a pulley 64 is mounted. The pulley 64 drives a belt 66 which in turn drives the friction drive means 50 and the ribbon supply 44. In particular, the belt 66 drives a pulley 68 which is mounted on a shaft 70 for driving the friction drive roller 54. The belt 66 also travels around a guide 72 and drives a pulley 74 which is mounted on a ribbon drive shaft 76 for driving the ribbon supply 44. A twisting guide 78 is provided to twist the belt 66, thereby achieving the desired direction of rotation of the ribbon drive shaft 76.

Figure 4A:
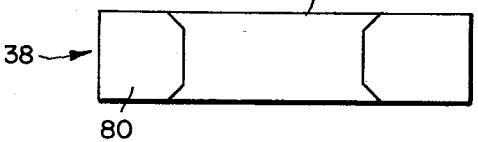
FIG. 4A is a bottom view of the platen 38.
Figure 4:
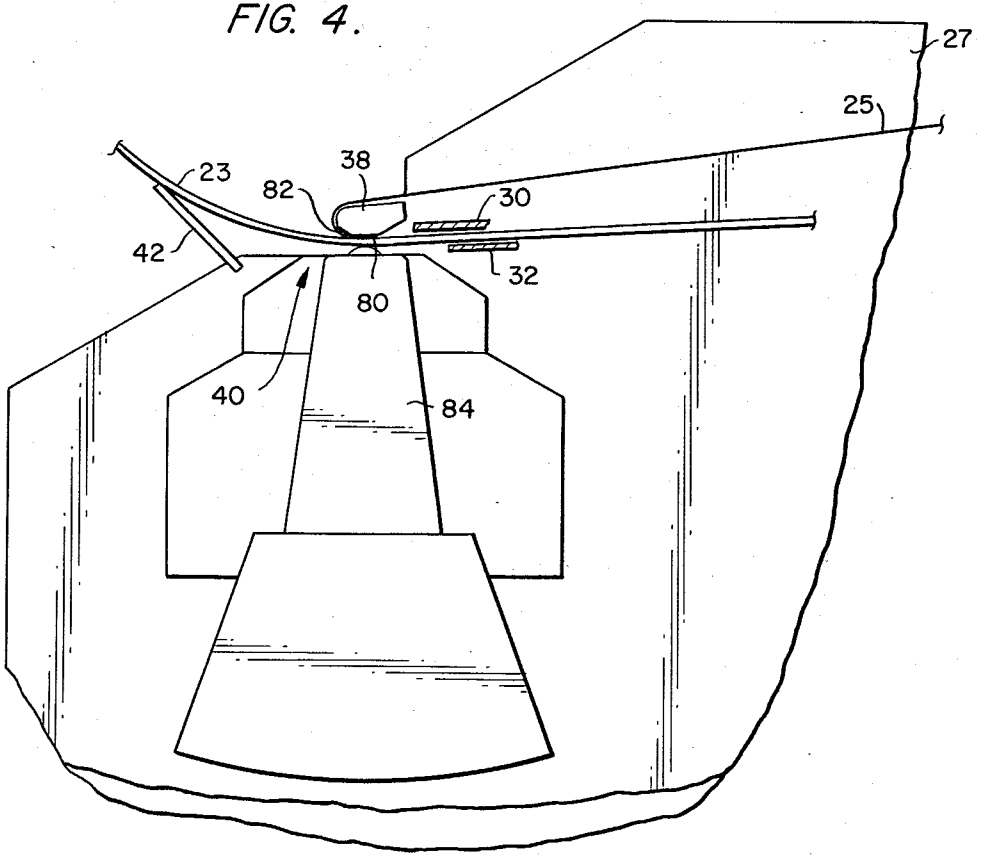
FIG. 4 is an enlarged side elevational view of the printing station including the platen.

FIG. 4 is an enlarged view of the printing heads 40 and the platen 38 which supports the label 23 during printing. In the preferred embodiment, the platen 38 is a specially machined metal platen, having a cut out guide portion 39 (FIG. 4A) which is the width of a label for guiding the label 23 so that the label 23 will not wander across the platen 38. The platen 38 may be made of any material (e.g., plastic) which is hard enough to provide support for the label 23 during the printing operation. The platen 38 has a flat portion 80 for supporting the label 23 during printing and a curved portion 82 for peeling the backing 25 from the label 23 after printing has been accomplished. That is, as the backing strip 25 is drawn the curved portion 82 of the platen 38, the relative rigidity of the label 23 causes the strip 25 to peel away from the gummed side of the printed label 23. The printed label 23 is then deflected out of the machine by the label deflector 42.

Figure 5:
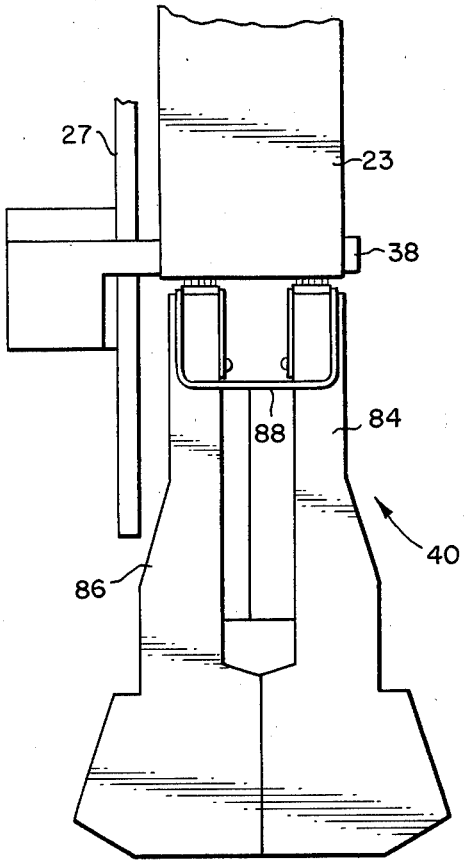
FIG. 5 is a view of the dual headed wire printer and metal platen taken along line 5—5 of FIG. 1.

FIG. 5 is a cross-sectional view taken along line 5—5 of FIG. 1 illustrating the printing heads 84 and 86. In the preferred embodiment, the printing heads 84 and 86 are wire print heads. The print heads 84 and 86 are held in position by a bracket 88 so that each of the wire print heads 84 and 86 prints one line of indicia on the label 23. In the preferred embodiment, each of the wire print heads 84 and 86 comprises a standard 7 wire solenoid actuated print head. The print heads 84 and 86 are alternately actuated so as to print first a dot column on one line of the label and then a dot column on the other. The dot columns of the two lines are offset by approximately ½ dot. In this manner, the wire print heads 84 and 86 can share the same control circuit for actuating the print heads.

Figure 6:
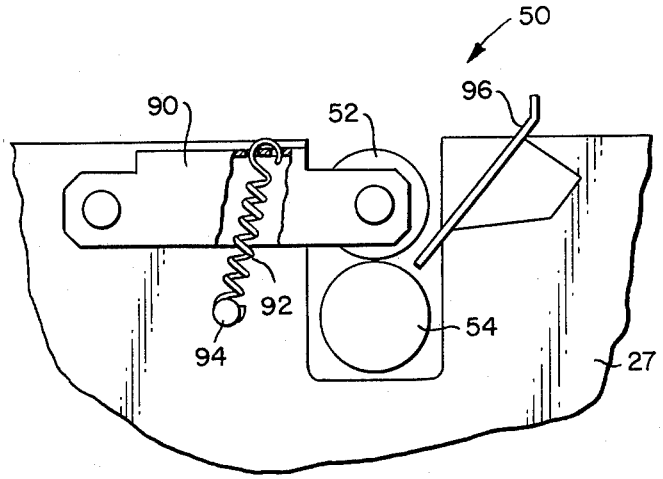
FIG. 6 is an enlarged side elevational view, partially cut away, illustrating the details of the friction rollers for driving the supply roll of labels.

FIG. 6 is an enlarged view of the friction drive means 50. One end of a bracket 90 is pivotally mounted to the printer housing 27 and the freely rotating friction roller 52 is rotatably mounted on the opposite end of bracket 90. The bracket 90, and thus the roller 52, are biased towards the driven friction roller 54 by a spring 92. The spring 92 is connected to the bracket 90 and to a projection 94 extending from the printer housing 27. A backing deflector 96 is mounted on the printer housing 27 and positioned so as to deflect the backing strip 25 out of the printing apparatus, thereby preventing the backing strip 25 from becoming tangled inside the printing apparatus.

Figure 7:
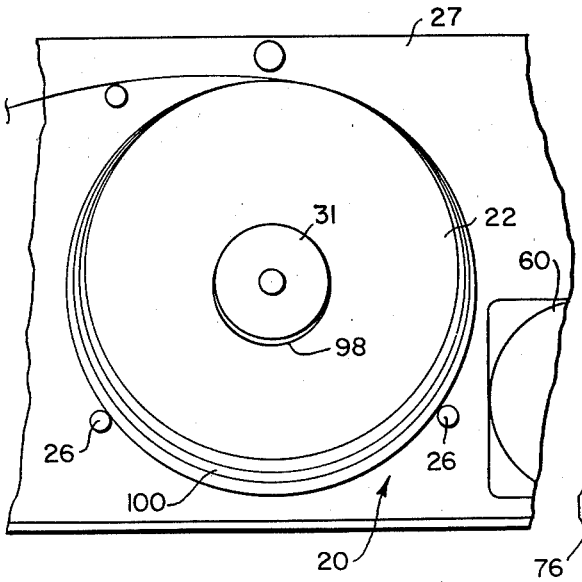
FIG. 7 is an enlarged side elevational view of the supply roll housing with the housing cover 24 removed.

FIG. 7 is a side view of the supply roll housing 20 with the label cover 24 removed. The core 98 of the supply roll 22 loosely surrounds the fixed spindle 31 and is freely rotatably thereon. Several unravelled outer turns 100 of the supply roll 22 are confined within the supply roll housing 20 by the spacers 26. The orientation of the supply roll 22 and the unravelled outer turns 100 within the supply roll housing 20 which is shown, correspond to a rest position in between the printing of the labels 23. Since the printing operation is intermittent, the motor 60 is selectively and intermittently actuated to rotate the driven friction roller 54 and the ribbon drive shaft 76 (FIG. 1) to withdraw the free end of the roll from the supply. Returning to FIG. 7, when the motor 60 is restarted and the driven friction roller 54 is rotated to frictionally drive the backing 25, the connected labels 23 from the unravelled outer turns 100 of the supply roll 22 have a low inertia and are freely withdrawn from the supply roll housing 20. That is, during start-up of the motor 60, the core 98 of the supply roll 22 will not be rotated on the fixed spindle 31; instead, the unravelled outer turns 100 will initially be withdrawn from the supply roll housing 20, thereby placing a minimal start-up torque on the motor 60. Eventually, the motor 60, through the driven friction roller 54 will rotate the core 98 of the supply roll 22 about the fixed spindle 31. When the motor 60 is turned off at the end of printing a label 23, the supply roll 22 due to its momentum will tend to continue to rotate for a time so that unravelled outer turns 100 again unwind within the supply roll housing 20. This start and stop and unravelling process is repeated for each label 23.

Figure 8:
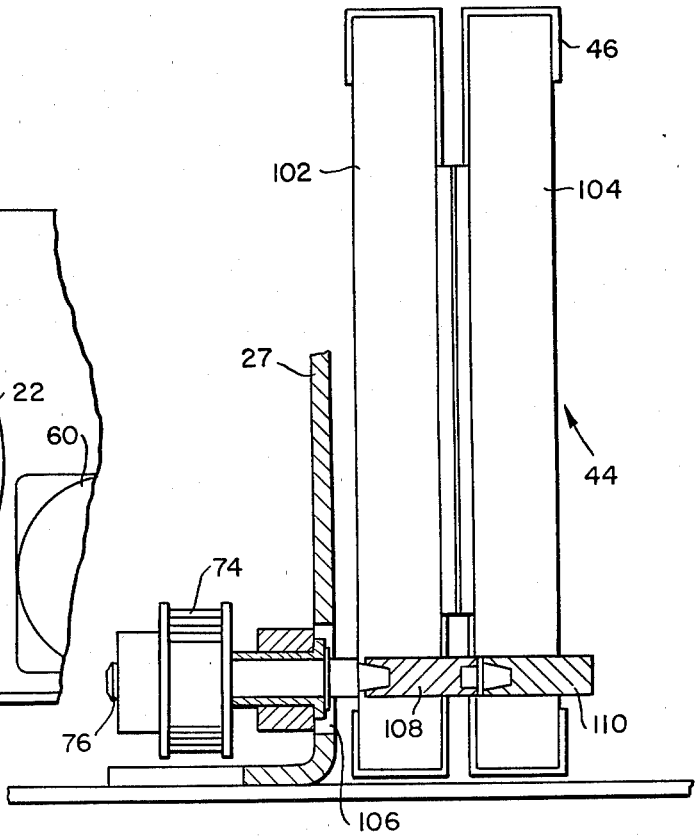
FIG. 8 is a cross-sectional view of the ribbon cartridge and ribbon drive taken along line 8—8 of FIG. 1.

FIG. 8 is a cross-sectional view of the ribbon supply 44 taken along line 8—8 of FIG. 1. The ribbon supply 44 includes ribbon cartridges 102 and 104 which are held by the bracket 46. Transport of the ribbon from the ribbon cartridges 102 and 104 is accomplished through the ribbon drive shaft 76. The ribbon drive shaft 76 is mounted through an aperture 106 in the printer housing 27. The ribbon drive shaft 76 drivingly engages a cartridge shaft 108 in the ribbon cartridge 102 which in turn drivingly engages a cartridge shaft 110 in the ribbon cartridge 104. The ribbon from the cartridge 102 is transported in between the wires on wire print head 86 and the label 23. Similarly, the ribbon in the ribbon cartridge 104 is transported in between the wires on wire print head 84 and the label 23. Referring to FIG. 1, the ribbon from the ribbon cartridges 102 and 104 is positioned at the printing station 40 by ribbon guides 112 and 114.

Figure 9:
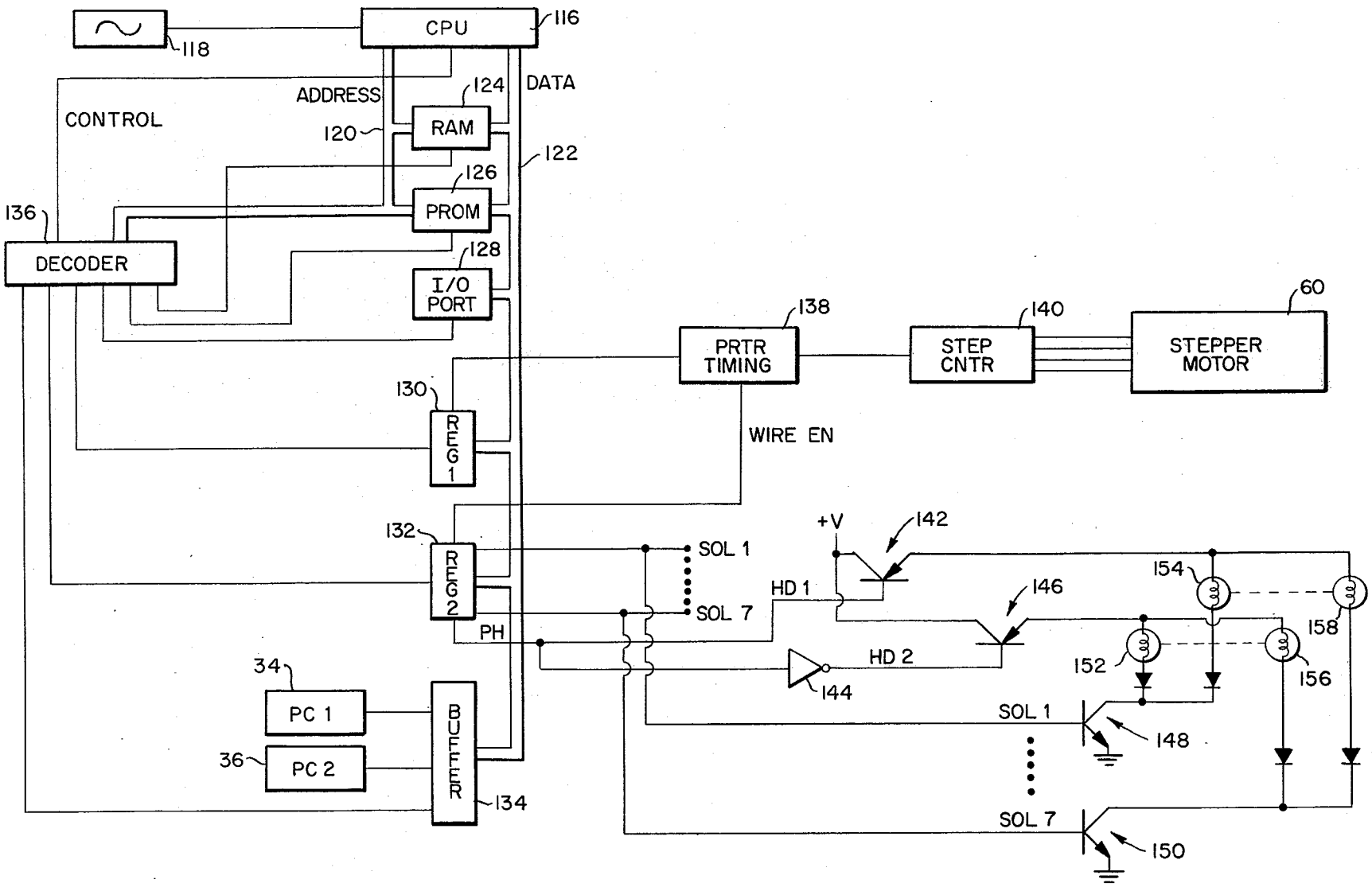
FIG. 9 is a block diagram illustrating the control circuit for controlling the printing apparatus of the present invention.

FIG. 9 is a block diagram of the control circuit for the printing apparatus of the present invention. A central processing unit (CPU) 116 controls the operation of the control circuit. An oscillator 118 generates clock signals for the CPU 116 and an address bus 120 and a data bus 122 are connected to the CPU 116. A random access memory (RAM) 124 is connected to the address bus 120 and the data bus 122 and provides a working memory for the CPU 116. A programmable read only memory (PROM) 126 is connected to the address bus 120 and the data bus 122 and stores the firmware under which the CPU 116 operates. In the preferred embodiment, the PROM 126 is an erasable programmable read only memory (EPROM). An I/O port 128 is connected to the data bus 122 and to an external device, and provides data from the external device to the CPU 116. In the preferred embodiment, the I/O port 128 is connected to the model PC4 Parcel Register manufactured by the Orbitran Division of Data Card Corporation, Assignee of the present application. A register (REG 1) 130 receives timing data from the CPU 116 on the data bus 122 and provides a timing signal as an output. A register (REG 2) 132 receives and stores character dot matrix data received from the CPU 116 via the data bus 122. A buffer circuit 134 is connected to the CPU 116 via data bus 122 and to the photocells 34 and 36. The buffer circuit 134 provides label position data to the CPU 116. A decoder circuit 136 decodes addresses on the address bus 120 in accordance with a control signal from the CPU 116 and selectively enables the RAM 124, the PROM 126, the I/O port 128, the register 130, the register 132 and the buffer circuit 134. A printer timing circuit 138 receives the timing data stored in the register 130 and provides a wire enable signal (WIRE EN) to the register 132 in accordance with the timing data. The printer timing circuit 138 also provides a timing signal to a step counter 140 which energizes the windings of the stepper motor 60 individually, to selectively advance the stepper motor 60 through its cycle.

As noted above, the register 132 stores data relating to the character dot matrix which is to be printed on the label. The register 132 provides a print head select signal (PH) in accordance with the wire enable signal (WIRE EN) from the printer timing circuit 138. The head 1 select signal (HD1) is provided to the base of a print head drive transistor 142 for actuating print head 86. In addition, the print head select signal (PH) is inverted by inverter 144 to become a head 2 select signal (HD2) which is provided to a print head drive transistor 146 for actuating the print head 84. Thus, the print heads 86 and 84 are alternately actuated by the control circuit. The register 132 also outputs data indicating which of the solenoids on the actuated head is to be turned on during a particular printing cycle (SOL 1–SOL 7). The solenoid enable signals are provided to the base of seven solenoid drive transistors (of which only a first solenoid drive transistor 148 and a seventh solenoid drive transistor 150 are shown) to selectively actuate the desired dot positions on a print head. Thus, the solenoid drive transistors are selectively turned on to actuate selected solenoid wires on the print head which is enabled during the particular printing cycle. For example, if solenoid drive transistor 148 is turned on, it will fire a solenoid 152 if the print head drive transistor 146 is enabled and alternatively will fire a solenoid 154 if the print head drive transistor 142 is enabled. Similarly, if the solenoid transistor 150 is turned on, it will fire a solenoid 156 if the print head drive transistor 146 is enabled and alternatively will fire a solenoid 158 if the print head drive transistor 142 is enabled. By using the control system of the present invention, a printer for printing on two lines of a label 23, using two wire print heads, can be achieved using only seven solenoid drive transistors (e.g., 148 and 150).

Figure 10:
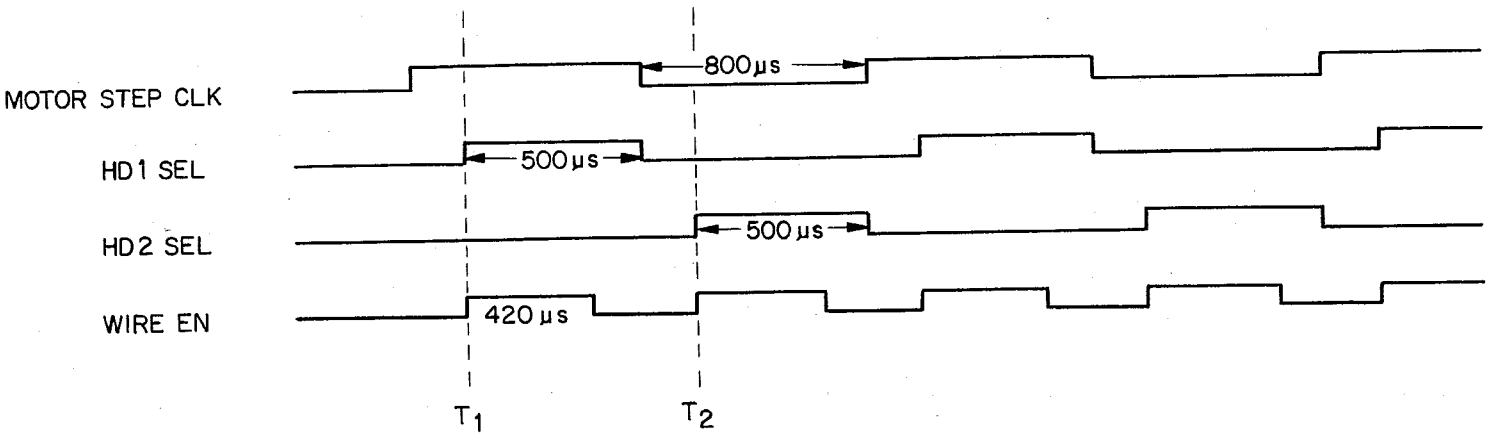
FIG. 10 is a timing diagram illustrating the timing for driving the stepper motor, the print heads, and selected print wires in each of the print heads.

FIG. 10 is a graph illustrating the timing which is generated by the printer timing circuit 138 of FIG. 9. At time T1, the head 1 select signal (HD1) drives the transistor 142 for 500 microseconds. Also at time T1, the solenoid enable signals actuate any or all of the seven wires on print head 86 for 420 microseconds to print one dot column of a character. After the head 1 select signal dissipates, the stepper motor 60 is incremented to the next position and the sequence is repeated for print head 84 starting at time T2. In the preferred embodiment, the dot columns which are printed by the print heads 84 and 86 are offset horizontally by one-half of the dot diameter.

Figure 11:
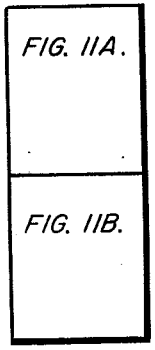
FIGS. 11A and 11B are a flow chart for illustrating the program stored in the PROM 126 of FIG. 9.
Figures 11A, 11B:
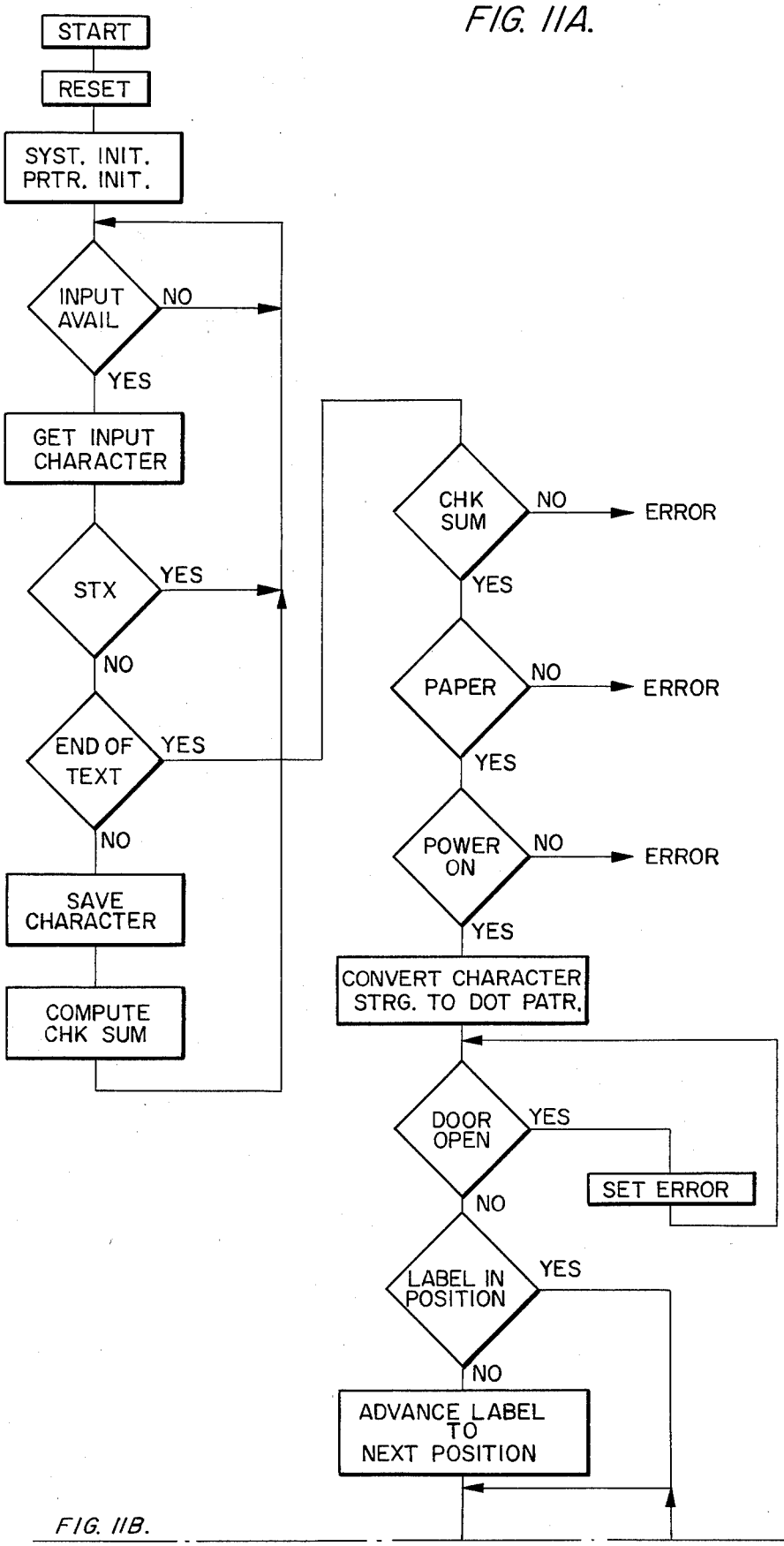
Figures 11A, 11B:
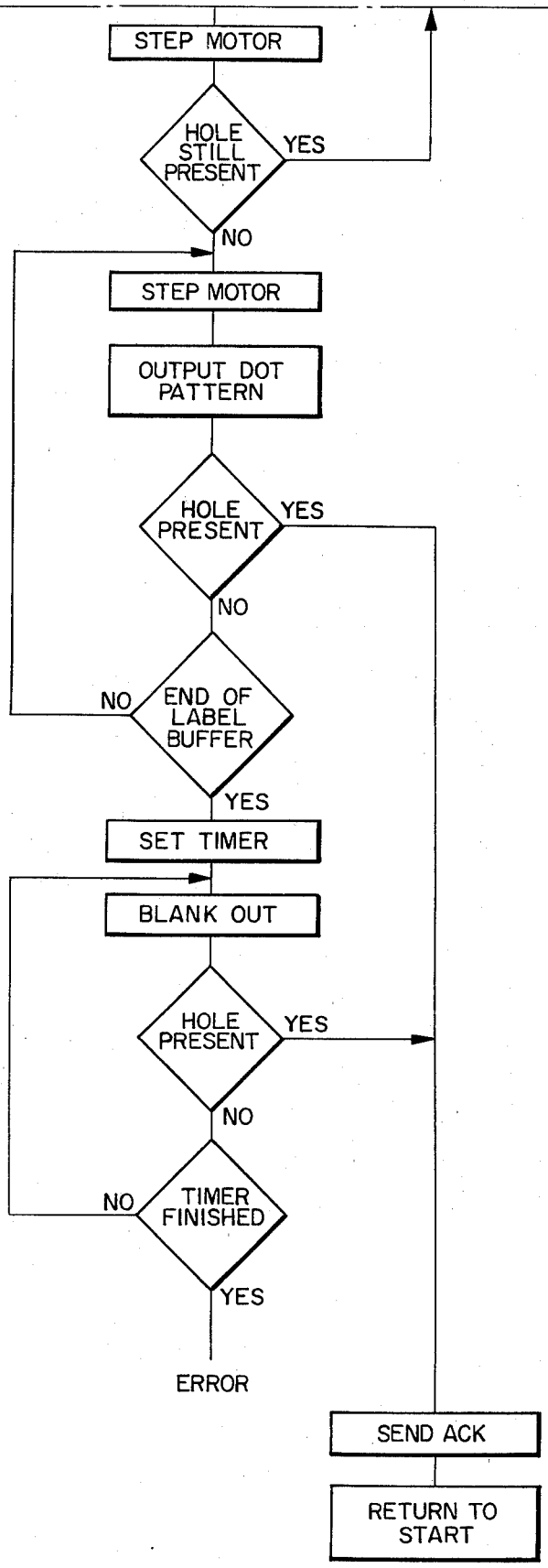

FIGS. 11A and 11B are flow charts for the CPU 116. After the system is started (START) it is reset (RESET) and the system and the printer are initialized (SYST INIT PRTR INIT). The CPU 116 then determines whether an input is available (INPUT AVAIL). In the preferred embodiment, the model PC4 parcel register is connected to the I/O port 128 and provides data which is to be printed on a label. It is this input which is being searched for by the CPU 116. If an input is not available, then there is a loop back and the step is repeated until an input is obtained. If an input is available, then the input is obtained from the I/O port 128 (GET INPUT CHARACTER), and the CPU 116 determines whether the input character is a start of text character (STX). This is essentially a determination of whether the character is a sync character or not. If it is a start of text character, then the CPU 116 loops back to get another character. If it is not a start of text character, then the CPU 116 determines whether it is an end of text character (END OF TEXT). If it is not an end of text character, then the character is saved (SAVE CHARACTER), a check sum is computed (COMPUTE CHECK SUM) and the system loops back to obtain another input character. The check sum is used to determine whether the data string or data block which comes from an external device is received correctly. The check sum will be sent at the end of a data block of information and is similar to a parity bit. Once an end of text character is received, the check sum at the end of the block of information is compared with the computed check sum (CHK SUM). If the check sums do not compare, then the system enters an error mode. If the check sums do compare, then the CPU 116 determines whether there is a roll of labels in the printing apparatus (PAPER). If there is no roll, then the system enters an error mode. If there are labels, the CPU 116 then determines whether all of the power circuits in the system are in the correct state (POWER ON). If the systems are not in the correct state, an error mode is entered. If the power circuits are in a correct state, the character string is then converted into a dot pattern (CONVERT CHARAC STRG TO DOT PATR). The character string which is converted includes the characters to be printed on an entire label.

After the character string is converted to a dot pattern, the CPU 116 determines whether the door to the apparatus is open (DOOR OPEN). If the door is open then an error mode is set and the system will not operate. This is a safety precaution to insure that the operator will not be injured by the printer. If the door is not open, the CPU 116 then determines whether a label 23 is in position (LABEL IN POSITION) and, if the label 23 is not in position, the label 23 is advanced to the next position (ADVANCE LABEL TO NEXT POSITION). After the label has been advanced to the next position (or if the label is already in position) the stepper motor 60 is started (STEP MOTOR). After the stepper motor 60 has been stepped, the CPU 116 determines whether a hole 21 in the label 23 is still being sensed by the photocell 34 or photocell 36 (HOLE STILL PRESENT). If the hole 21 is still sensed, the system loops back and steps the stepper motor again. The CPU 116 is essentially looking for the leading edge of the hole 21 in the label 23. Once the leading edge has been detected, the stepper motor 60 is again turned on (STEP MOTOR) and the first column of the dot pattern is printed (OUTPUT DOT PATTERN). After outputting the dot pattern, the CPU 116 determines whether a hole 21 is sensed (HOLE PRESENT). If a hole 21 is not sensed, the CPU 116 then determines whether the label buffer 134 is empty (END OF LABEL BUFFER). If the label buffer 134 is not empty, the CPU 116 then actuates the stepper motor 60 and outputs another dot pattern. After all necessary indicia has been printed on a label, then one of two situations will occur. If a hole 21 is sensed the CPU 116 will send an acknowledgement signal (SEND ACK) and will return to start (RETURN TO START). If the hole 21 is not sensed but the label buffer 134 is empty, a timer is set (SET TIMER). The label 23 is then advanced without printing (BLANK OUT) and the CPU 116 checks to see whether a hole 21 is sensed (HOLE PRESENT). If a hole 21 is sensed, then the CPU 116 sends an acknowledgement signal to the external device and returns to start. If the hole 21 is not sensed, the CPU 116 determines whether the timer has timed out (TIMER FINISHED). If the timer has finished, this means that the label 23 is not moving and an error signal is generated. If the timer is not finished, the CPU 116 keeps advancing the label and checking for a hole 21 until the timer times out. Assuming the label finishes advancing to the next hole and the acknowledgement signal has been sent, the program returns to start and a new label 23 may be printed.

Referring to drawings, the operation of the printing apparatus of the present invention will be described. Indicia to be printed on a label 23 is provided via the I/O port 128 to the control circuit of the printing apparatus of the present invention (FIG. 9). This may be by way of the model PC4 Parcel Register system or by any other suitable device for providing indicia to be printed on a label. The CPU 116 transmits timing data to the register 130 and character dot data to the register 132. The printer timing circuit 138 controls the timing of the print heads 84 and 86 and the rotation of the stepper motor 60 (FIG. 5). The printer timing circuit 138 alternately actuates wire printing head 84 and wire printing head 86, selectively enabling the solenoid wires on each of the heads. The stepper motor 60 drives the driven friction roller 54 by ½ dot increments so that the print heads 84 and 86 will print two lines of indicia across a label 23. When the stepper motor begins to rotate it withdraws a segment of the unravelled outer turns 100 of supply roll 22 from the supply roll housing 20 (FIG. 7). Since the unravelled outer turns 100 have low inertia, the start-up torque on the stepper motor 60 is very minimal. Gradually the unravelled outer turns 100 are withdrawn and eventually the supply roll 22 begins to rotate. When the stepper motor 60 is halted (after printing a label 23), the momentum of the supply roll 22 causes the supply roll 22 to continue to rotate on the fixed spindle 31 so that the unravelled outer turns 100 are again formed within the confines of the spacers 26 of the supply roll housing 20. One of the photocells 34 and 36 provides a detection signal when the hole 21 in the label 23 is detected. As the label 23 is being printed, the backing 25 is peeled from the label 23 as it moves past the platen 38 and the backing strip 25 is fed between the friction rollers 52 and 54 at a location away from the platen 38 to transport the label supply to the printing station 40.

The combination of the photocells 34 and 36 and the low inertia supply roll housing 20 affords precise control of the positioning of the labels 23 for intermittent printing on preprinted labels. Since in many instances, it is desirable to provide a roll of labels having certain uniform indicia already printed thereon, it is necessary to accurately align these preprinted labels when individualized indicia is to be printed thereon. The printing apparatus of the present invention provides the precise control necessary for such printing.

The printing apparatus of the present invention may be inplemented in various ways. For example, instead of using the printing apparatus of the present invention as a stand alone printer which is connected via its I/O port 128 to an external device such as the model PC4 parcel register, the printer may be made an integral part of a parcel register system (e.g., the model PC5 parcel register manufactured by the Orbitran Division of Data Card Corporation). If the printing apparatus of the present invention is made an integral part of a parcel register system, it is readily operated under the control of the system program of the parcel register system and the control circuit of FIG. 9 is suitably modified accordingly. In addition, any suitable type of matrix printer (e.g., an ink jet printer) may be employed. Further, any suitable ribbon supply may be employed in place of the ribbon cartridge in the printing apparatus of the present invention.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed is:

1. A printing apparatus for selectively printing on labels, having a backing strip, supplied by a continuous supply roll, comprising:

housing means for supporting the supply roll for free rotation about an axis and for limiting the radius of the unravelled outer turns of the supply roll, said housing means comprising:

a printer housing;

a fixed spindle mounted on said printer housing, the supply roll being freely rotatable on said fixed spindle;

at least two spacers extending from said printer housing radially of said fixed spindle so as to limit the radius of the supply roll including the unravelled outer turns of the supply roll; and a housing cover mounted on said fixed spindle;

sensor means for sensing the position of a label to be printed and for generating a position signal;

control means, operatively connected to said sensor means, for receiving said position signal and for generating an advance signal and a print signal;

printing means, operatively connected to said control means, for printing indicia on a label supplied by the supply roll and for peeling the printed label from the backing;

friction drive means, for frictionally engaging the backing and for transporting the labels past said printing means; and a motor, operatively connected to said control means, for selectively and intermittently driving said friction drive means in accordance with said advance signal, said housing means holding the supply roll so that the unravelled outer turns of the supply roll abut said at least two spacers prior to the time said motor is driven, said motor having a low start-up torque due to the free rotation of the supply roll in said housing means.

2. A printing apparatus as set forth in claim 1, wherein said friction drive means comprises:

a first roller driven by said motor and a second roller spring urged toward said first roller so that said first and second rollers frictionally engage the backing and are driven to transport the backing.

3. A printing apparatus as set forth in claim 2, wherein said first and second rollers are urethane rollers.

4. A printing apparatus as set forth in claim 1 or 2, wherein said printing means comprises:

a wire printer, operatively connected to said control means, for printing indicia on a label from the supply roll; and a platen for supporting the label as it is transported past said wire printer and for peeling the printed label from the backing strip as the backing strip is drawn over said platen.

5. A printing apparatus as set forth in claim 4, wherein said wire printer is a stationary dual headed wire printer having first and second print heads which are alternately actuated by said print signal so as to print first and second lines of indicia, respectively, on a label.

6. A printing apparatus as set forth in claim 4, wherein said platen is metal.

7. A printing apparatus as set forth in claim 1, wherein said motor is a DC stepper motor.

8. A printing apparatus as set forth in claim 1, wherein said sensor means comprises a photocell.

9. A printing apparatus as set forth in claim 1, further comprising ribbon supply means driven by said motor.

10. A printing apparatus as set forth in claim 9, wherein said driven ribbon supply means comprises a ribbon drive shaft driven by said motor and first and second ribbon cartridges drivingly connected to said ribbon drive shaft.

11. A printing apparatus as set forth in claim 1, wherein each of the labels has an aperture and wherein said sensor means senses the aperture to sense the position of the label to be printed.

12. A printing apparatus as set forth in claim 1, wherein each of the labels has an aperture and is preprinted with uniform indicia and wherein said sensor means senses the aperture and provides said position signal to said control means, so that said printing means prints on the same portion of each of the labels.

13. A printing apparatus for selectively printing on labels, having a backing strip, supplied by a continuous supply roll, comprising:

housing means for supporting the supply roll for free rotation about an axis and for limiting the radius of the unravelled outer turns of the supply roll;

sensor means for sensing the position of a label to be printed and for generating a position signal;

control means, operatively connected to said sensor means, for receiving said position signal and for generating an advance signal and a print signal;

a stationary dual headed wire printer having first and second print heads which are alternately actuated by said print signal so as to print first and second lines of indicia, respectively, on a label;

friction drive means, for frictionally engaging the backing and for transporting the labels past said stationary dual headed wire printer;

a motor, operatively connected to said control means, for selectively and intermittently driving said friction drive means in accordance with said advance signal, said housing means holding the supply roll so that the unravelled outer turns of the supply roll are present prior to the time said motor is driven, said motor having a low start-up torque due to the free rotation of the supply roll in said housing means;

a ribbon drive shaft driven by said motor; and first and second ribbon cartridges drivingly connected to said ribbon drive shaft, said first and second ribbon cartridges associated with said first and second print heads, respectively, the ribbon supplied by said first and second ribbon cartridges being positioned between a label and said first and second print heads, respectively.

14. A printing apparatus for selectively printing on labels, having a backing strip, supplied by a continuous supply roll, comprising:

housing means for supporting the supply roll for free rotation about an axis, said housing means comprising means for limiting the radius of the unravelled outer turns of the supply roll;

sensor means for sensing the position of a label to be printed and for generating a position signal;

control means, operatively connected to said sensor means, for receiving said position signal and for generating an advance signal and a print signal;

printing means, operatively connected to said control means, for printing indicia on a label supplied by the supply roll and for peeling the printed label from the backing;

friction drive means, for frictionally engaging the backing and for transporting the labels past said printing means;

a motor, operatively connected to said control means, for selectively and intermittenly driving said friction drive means in accordance with said advance signal, said housing means holding the supply roll so that the unravelled outer turns of the supply roll abut said limiting means prior to the time said motor is driven, said motor having a low start-up torque due to the free rotation of the supply roll in said housing means; and ribbon supply means driven by said motor, said ribbon supply means comprising a ribbon drive shaft driven by said motor, and first and second ribbon cartridges drivingly connected to said ribbon drive shaft.

* * * * *

UNITED STATES PATENT AND TRADEMARK OFFICE

CERTIFICATE OF CORRECTION

PATENT NO. : 4,386,860

DATED : JUNE 7, 1983

INVENTOR(S) : ROBERT J. PRICE ET AL.

It is certified that error appears in the above-identified patent and that said Letters Patent is hereby corrected as shown below:

Front page, [56] References Cited,
U.S. PATENT DOCUMENTS line 5, "Chon et al." should be
--Chou et al.--.

Signed and Sealed this

*Eighth* Day of *November 1983*

[SEAL]

*Attest:*

GERALD J. MOSSINGHOFF

*Attesting Officer*

*Commissioner of Patents and Trademarks*